US007841512B2

(12) United States Patent
Westerman et al.

(10) Patent No.: US 7,841,512 B2
(45) Date of Patent: Nov. 30, 2010

(54) FOLDED CORRUGATED CONTAINER WITH REINFORCED QUICK-LOCKING HANDLES

(75) Inventors: Frank E. Westerman, Hot Springs, AR (US); Frank G. Westerman, Maumelle, AR (US)

(73) Assignee: Wes Pak, Inc., Alexander, AK (US)

( * ) Notice: Subject to any disclaimer, the term of this patent is extended or adjusted under 35 U.S.C. 154(b) by 757 days.

(21) Appl. No.: 11/654,875

(22) Filed: Jan. 19, 2007

(65) Prior Publication Data

US 2008/0173703 A1 Jul. 24, 2008

(51) Int. Cl.

| | |
|---|---|
| ***B65D 5/36*** | (2006.01) |
| ***B65D 5/46*** | (2006.01) |
| ***B65D 43/08*** | (2006.01) |
| ***B65D 5/00*** | (2006.01) |
| ***B65D 5/24*** | (2006.01) |

(52) U.S. Cl. ..... 229/125.28; 229/117.19; 229/117.01; 229/186; 229/117.16; 229/145; 229/149; 229/125.19; 229/117.15

(58) Field of Classification Search ..... 229/117.01, 229/125.28, 125.19, 186, 117.06, 145, 149, 229/117.16, 117.22, 117.13, 117.15, 117.19, 229/117.24, 117.25, 117.26

See application file for complete search history.

(56) References Cited

U.S. PATENT DOCUMENTS

| | | | | |
|---|---|---|---|---|
| 886,710 | A * | 5/1908 | Low | 229/125.19 |
| 888,653 | A * | 5/1908 | Potter | 383/13 |
| 996,746 | A * | 7/1911 | Bloomer | 229/138 |
| 1,061,531 | A * | 5/1913 | Emmone | 229/122.34 |
| 1,150,105 | A * | 8/1915 | Emmons | 229/125.19 |
| 1,153,136 | A * | 9/1915 | Rosenfeld | 229/117.22 |
| 1,171,228 | A * | 2/1916 | Misroch et al. | 229/117.22 |
| 1,671,020 | A * | 5/1928 | Feinberg | 229/117.04 |
| 1,721,143 | A * | 7/1929 | Berkowitz | 206/8 |
| 2,007,810 | A | 7/1935 | Oman | |
| 2,008,443 | A | 7/1935 | Froehlig | |
| 2,147,503 | A | 2/1939 | Seifer | |
| 2,151,472 | A * | 3/1939 | Hubbard | 229/120.36 |
| 2,269,013 | A | 1/1942 | Irving | |
| 2,355,578 | A * | 8/1944 | Williams et al. | 229/125.28 |
| 2,386,905 | A * | 10/1945 | Meltzen | 229/189 |
| 2,714,982 | A | 8/1955 | Strauss | |

(Continued)

FOREIGN PATENT DOCUMENTS

GB 2262508 A * 6/1993

*Primary Examiner*—Gary E Elkins
*Assistant Examiner*—Latrice Byrd
(74) *Attorney, Agent, or Firm*—Stephen D. Carver

(57) ABSTRACT

A container comprises a knockdown carton made from a flat blank of corrugated material, and a knockdown lid. The carton comprises a center panel, foldable end panels, foldable side panels, and foldable corner panels. A pair of diametrically opposed corner panels are folded inwardly into contact with opposed end panels. The end panels comprise rectangular cutout holes surrounding foldable flaps. The lid has a central panel that is divided from integral end panels and integral side panels. A lid side panel extending vertically downwardly is coupled to the carton. Lid end panels have elliptical orifices that register with carton cutout regions and adjoining slots that align with handle anchor orifices. An alternative lid has flaps comprising major and minor segments separated by a diagonal fold line. The minor segment has an apex that releasably biases the flap in engagement with the end panel, yieldably locking the lid.

14 Claims, 14 Drawing Sheets

U.S. PATENT DOCUMENTS 2,745,589 A * 5/1956 Daly et al. ..... 229/117.16
2,805,813 A 9/1957 Rittmueller
2,869,771 A * 1/1959 Bothwell ..... 229/117.24
3,131,849 A 5/1964 Paige
3,134,531 A * 5/1964 Hardy, Jr. ..... 229/117.24
3,140,813 A 7/1964 Hall et al.
3,140,814 A * 7/1964 Ellis ..... 229/117.24
3,182,913 A * 5/1965 Brian ..... 229/117.13
3,193,176 A * 7/1965 Gullickson ..... 229/117.06
3,194,480 A 7/1965 Andre
3,199,760 A * 8/1965 Conescu ..... 229/117.06
3,207,357 A * 9/1965 Schmitt ..... 220/62
3,246,829 A * 4/1966 Sexton ..... 229/228
3,254,827 A 6/1966 Chapman
3,342,401 A * 9/1967 Kitchell ..... 229/125.28
3,465,948 A 9/1969 Boyer
3,774,836 A * 11/1973 Nunn ..... 229/117.24
3,780,934 A 12/1973 Gardner
3,899,121 A * 8/1975 Herbetko ..... 206/509
3,900,157 A * 8/1975 Roth ..... 206/737
3,940,055 A * 2/1976 Rowley ..... 229/117.15
4,101,052 A * 7/1978 Dove ..... 229/101
4,119,265 A * 10/1978 Dlugopolski ..... 229/154
4,167,242 A * 9/1979 Kupersmit ..... 229/117.19
4,171,763 A 10/1979 Card
4,174,051 A 11/1979 Edwards et al.
4,176,423 A * 12/1979 Wigemark ..... 16/406
4,238,069 A 12/1980 Morris, Jr.
4,252,266 A * 2/1981 Kupersmit ..... 229/117.01
4,328,923 A 5/1982 Graser
4,403,728 A 9/1983 Koltz
4,465,227 A 8/1984 Hood et al.
4,489,878 A * 12/1984 Mode ..... 229/117
4,546,914 A * 10/1985 Roccaforte ..... 229/117.13
4,583,681 A * 4/1986 Neese ..... 229/117.22
4,687,130 A 8/1987 Beeler
4,784,497 A 11/1988 Dutton
5,018,663 A 5/1991 Corso
5,020,337 A 6/1991 Krieg
5,042,715 A 8/1991 McNeill
5,050,766 A 9/1991 Groh
5,062,527 A * 11/1991 Westerman ..... 229/117
5,074,460 A 12/1991 Hanekamp
5,094,359 A 3/1992 DeMars
5,263,339 A 11/1993 Evans
5,284,294 A * 2/1994 Floyd ..... 229/179
5,303,863 A 4/1994 Arasim
5,307,986 A 5/1994 Schuster
5,392,984 A 2/1995 Yocum
5,398,868 A * 3/1995 Densen ..... 229/125.08
5,562,228 A 10/1996 Ericson
5,562,229 A 10/1996 Ericson
5,853,121 A 12/1998 Francisco
6,164,526 A 12/2000 Dalvey
6,253,993 B1 7/2001 Lloyd et al.
6,736,309 B1 * 5/2004 Westerman et al. .... 229/117.05
6,926,192 B1 * 8/2005 Dowd ..... 229/117
7,188,713 B1 * 3/2007 Espar et al. ..... 190/2
7,249,674 B2 * 7/2007 Mu et al. ..... 206/278.1
7,367,490 B2 * 5/2008 Forthaus et al. ..... 229/117.24
7,441,693 B2 * 10/2008 Liao ..... 229/117.19
2004/0104264 A1 * 6/2004 Meeker ..... 229/117.19

* cited by examiner

FOLDED CORRUGATED CONTAINER WITH REINFORCED QUICK-LOCKING HANDLES

BACKGROUND OF THE INVENTION

I. Field of the Invention

This invention relates generally to portable, corrugated or paperboard containers that have been reinforced for rugged use. More particularly, our invention relates to foldable containers suitable for transporting liquid wastes including medical wastes. Prior art that is germane to the invention is located in U.S. Class 229, Subclasses 117, and 177-179.

II. Description of the Prior Art

Portable, box-like containers have been proposed in the prior art for storing a variety of wet or liquid substances, including various medical wastes. For example, prior U.S. Pat. No. 5,062,527, entitled Foldable, Leak-proof Multimode Carton Construction, issued Nov. 11, 1991 and owned by Wes Pak Inc., the assignee in this case, provides a foldable, leak proof waste container that is "slotless." The container is foldably deployed from a compact shipping configuration from a flat blank, made of paperboard, cardboard, or corrugated material. Each blank comprises a center panel, a pair of bordering width panels, a pair of bordering length panels, and four corner panels, separate by a plurality of orthogonal and diagonal fold lines that enable foldable deployment. In addition, knock down lines and relief lines formed in the center panel facilitate a "knock-down" feature enabling an assembled carton to be collapsed or flattened for storage. An optional top is disclosed in the patent.

As explained in the above-referenced U.S. Pat. No. 5,062,527, potential dangers associated with the handling and disposal of medical wastes are well recognized. Life-threatening diseases such as hepatitis, AIDS, and others can be contracted through inadvertent contact with contaminated waste materials or medical products such as syringes. Thus numerous attempts exist in the art to provide safe medical waste containers.

U.S. Pat. No. 4,644,386 issued Feb. 16, 1988 to Padgett employs a nonwoven flexible disposal bag which can be stored flat and sealed for sterilization. An alternative embodiment teaches the use of a carton provided with an impermeable plastic seal which can be used for disposal of large objects such as animal cadavers and the like. To prevent contamination during transport, the carton must be heat-sealed or sealed with an adhesive.

U.S. Pat. No. 4,784,497 issued Nov. 15, 1988 to Dutton teaches a flat, paperboard blank which can be conveniently carried and readily assembled into a rectangular carton for disposal of small litter such as cups, cans, and tissues.

Other references of interested include U.S. Pat. Nos. 4,801,006 issued Jan. 31, 1989 and 4,724,955, issued Feb. 16, 1988. Both of the last-mentioned references teach the use of containers for mounting a plurality of flexible litter disposal bags. When one litter bag is used, the bag is removed for disposal, and a subsequent fresh bag is exposed for immediate use.

It is also known in the prior art to provide a container with a leak-proof or insulating liner for storing various types of liquids. U.S. Pat. No. 3,262,628 issued Jul. 26, 1966 discloses a carton in which a flexible molded plastic drum is locked into position for safe shipping.

U.S. Pat. No. 3,927,821 issued Dec. 23, 1975 to Dunning teaches the use of a flexible plastic liner adhered to the inner walls of a cardboard carton. The liner is sealed to the carton by a vacuum heat shrink process.

The laminated container taught by Bamburg, U.S. Pat. No. 3,910,482 issued Oct. 7, 1975 provides two layers of leak-proof liner which are glued together to seal overlapping seams.

In normal use, medical waste containers may be moved between various facility rooms or collection areas, as they are gradually filled with waste. When the containers are moved about, the covers are temporarily secured in place atop the main container. Many prior art medical waste containers include lids or covers that are semi-permanently attachable to the container. The lids should be securely placed on the container when the box is moved about, but the lids should be easily releasable and quickly foldable to an out-of-the way position. Often there are slots or access ports defined in the body of the container that facilitate grasping and manipulation. For example, with suitable end slots defined in the body, a firm grasp may be achieved by inserting one's fingers at least partially into the ports. However, inadvertent contact with the box contents, such as syringes, must be avoided.

Corrugated or paperboard containers such as those described in the aforementioned references have a wide variety of uses other than medical applications. For example, boxes constructed substantially as described in aforementioned in U.S. Pat. No. 5,062,527, can be effectively utilized as food or beverage coolers. Many such designs are both durable and wear resistant, so that a hefty load of ice may be stored. Moreover, the slotless construction inherently prevents leaks. However, when a cooler is heavily loaded and handled roughly there is inevitable degradation over time. The handles are particularly vulnerable to weakening over time. Known handle constructions serve a dual purpose. For example, it is desirable for some containers such as portable medical waste containers to have a removable top that can be selectively, temporarily locked in place, and then easily unlatched and removed. It is known to connect various handle slots with suitable tabs for fastening the box top. Secondly and more obviously, the handles provide a convenient grasping point for manually toting the container about. As the handles are contacted vigorously and often strained by twisting and bending forces, they tend to weaken and break down over time.

We have found it desirable to provide a ruggedize handle construction that can be incorporated in the folding design of slotless, corrugated containers. By aligning multiple, properly scored slots in both end panels and folding corner panels, a ruggedized construction results.

SUMMARY OF THE INVENTION

A foldable, box-like container comprises a knockdown carton made from a flat blank of corrugated material, and a knockdown lid. The carton is made by folding a blank that is die-cut from corrugated sheet stock, and preferably lined or coated with a substance such as plastic.

Each blank comprises a generally rectangular center panel integrally bordered by a pair of end panels and a pair of side panels. Four, integral, diametrically spaced apart corner panels interconnect the center panel with the end and side panels. Each corner panel is bifurcated into adjacent triangular halves by a suitable diagonally extending score line. Numerous orthogonal score lines defined between other panels facilitate subsequent folding of the blank for erection of the container.

Each of the end panels each comprises centered, rectangular cutout regions including bendable flaps that can be deflected into an assembled container to form a grasping recess that functions as a handle. Preferably each end panel also comprises a pair of spaced apart anchoring holes disposed on each side of the rectangular cutout region for securing the ends of optional, plastic handles. Two diametrically oppositely positioned corner panels are specially configured. Each corner panel is divided into triangular halves that are folded into abutment with each other. Each half has a rectangular cutout region formed in it that, upon folding, aligns with one another and with the rectangular cutout region in the end panel to form a reinforced grasping region. Preferably, anchoring holes are defined on each side of the rectangular cutout region in each corner panel half to register with the end panel anchoring holes for lockably receiving ends of separate plastic handles.

The preferred lid has a central panel that is divided from integral end panels and integral side panels. A lid side panel extending vertically downwardly is glued to the carton. A preferred lid has end flaps with an elliptical, slotted orifice aligned with the cutout orifices in the end panels that clear the resilient handle. An alternative lid has end panels with rectangular, two-piece flaps that register with carton cutout regions. The lid flaps comprise major and minor segments that separated by a diagonal fold line. The minor segment has an apex that releasably engages the carton end panel to yieldably lock the lid in place atop the carton.

Thus a broad object of our invention is to provide a foldable, corrugated container with a reinforced grasping region that provides a ruggedized handle.

Another object is to provide a secure cover for containers of the character described that semi-permanently locks in place atop the container.

A related object is to provide a cover that can be selectively released when desired.

Another important object is to provide a slotless, foldable, leak-proof medical waste container.

Another important object is to provide a container of the character described comprising a cover that, after being temporarily fastened shut to facilitate transportation, may be quickly opened as desired once the carton is relocated.

Another object is to provide a container which is ideal for packaging, distributing, handling and storing of sterile and non-sterile medical surgical supplies.

A related object is to provide inexpensive blanks made of corrugated material that easily fold into ruggedized containers.

A still further object is to provide a container of the character described that is quickly, foldably transformed between a flat, transportation or storage orientation, and the deployed orientation.

A further basic object of the present invention is to provide a container which can be safely used for storing medical waste products, which includes a temporarily and permanently lockable cover.

Still another object of the present invention is to provide a knock-down container that can be partially erected and thereafter non-destructively collapsed.

A still further object is to provide a corrugated container of the character described which may be formed simply by folding a corrugated blank, but which may be easily flattened into a transportable or storage position.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
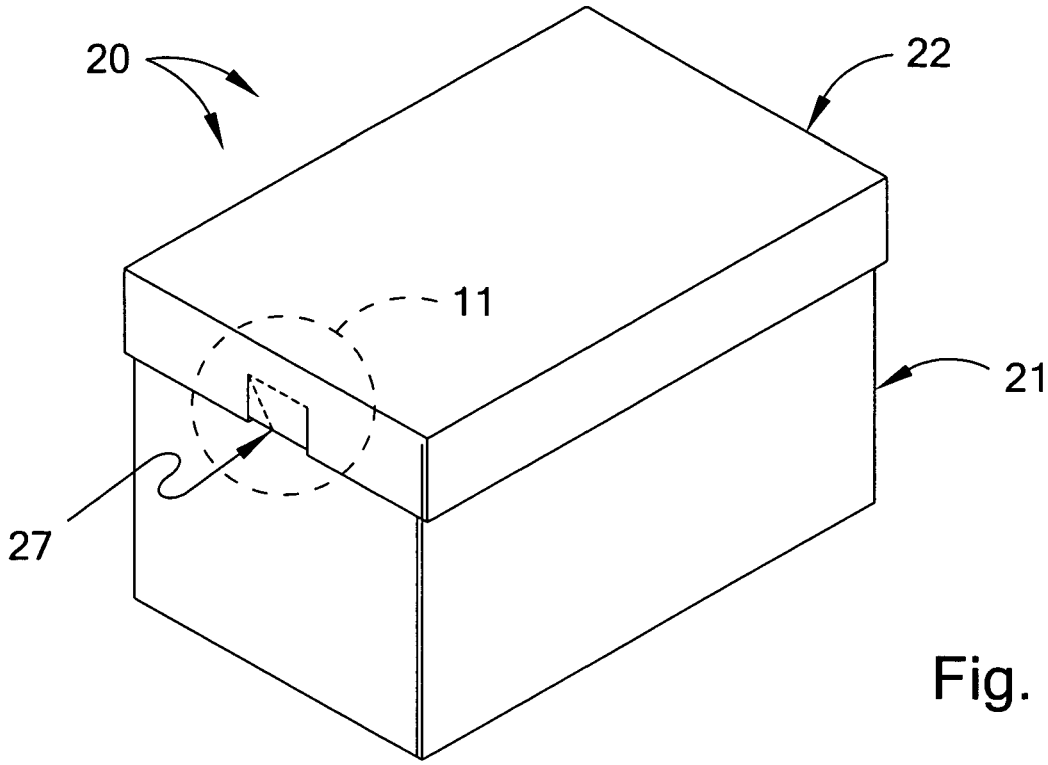
FIG. 1 is an isometric view of a first embodiment of our new container, with the optional lid installed upon the preferred carton, with the lid's locking flap unfolded.
Figure 2:
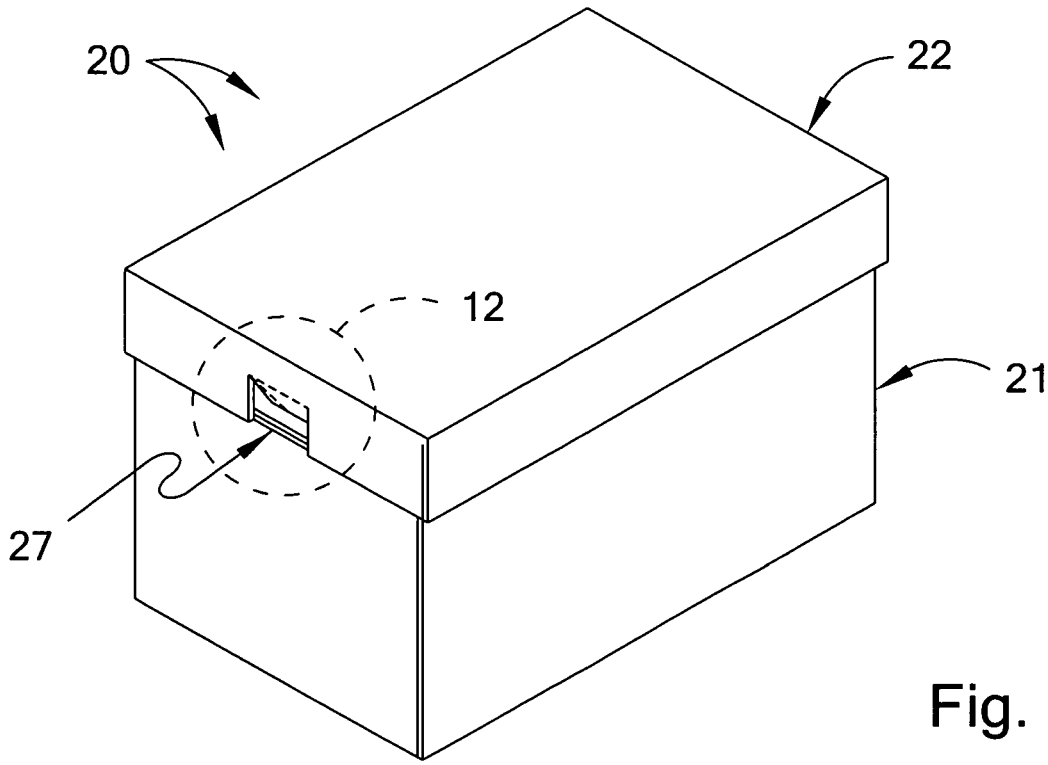
FIG. 2 is an isometric view similar to FIG. 1, showing the lid installed and the locking flap partially deployed.

With initial reference now directed to FIGS. 1-4 of the appended drawings, our preferred container has been generally designated by the reference numeral 20. The preferred container is ideal for packaging, distributing, handling and storing sterile and non-sterile medical and surgical supplies. Container 20 is also designed to safely hold medical or other moist or liquid wastes. However, it will be appreciated that other non-medically related materials can be accommodated as well. Container 20 comprises a folded carton 21 to which is fitted a cooperating lid 22 (or the preferred lid detailed hereinafter). The chosen lid is attached to the carton 21 to at least temporarily enclose it.

Carton 21 is made by deploying a generally planar blank 24 (FIG. 3), which is folded as hereinafter described. It will be apparent to those skilled in the art that both the carton 21 and its companion lid 22 can be designed in a variety of different volumes and geometrical configurations. The preferred flap system 27 (i.e., FIGS. 1, 2, 11, 12) that will be discussed in detail hereinafter, enables grasping of the carton without a lid, and it enables lid 22 to be temporarily latched to the carton 21.

Blank 24 (FIG. 3) is folded to transform itself into the carton 21 such that no leak paths or slots are formed. After erection the carton may be flattened for storage or shipping as hereinafter described (i.e., FIGS. 7-9). For purposes of disclosure, Prior Wes Pak. U.S. Pat. No. 5,062,527 entitled "Foldable, Leakproof Multimode Carton Construction," issued Nov. 11, 1991, and U.S. Pat. No. 6,736,309, entitled "Quick Erecting Foldable Portable Cooler," issued May 18, 2004, which describe much of the blank and its primary fold lines, are hereby incorporated by reference herein.

Figure 3:
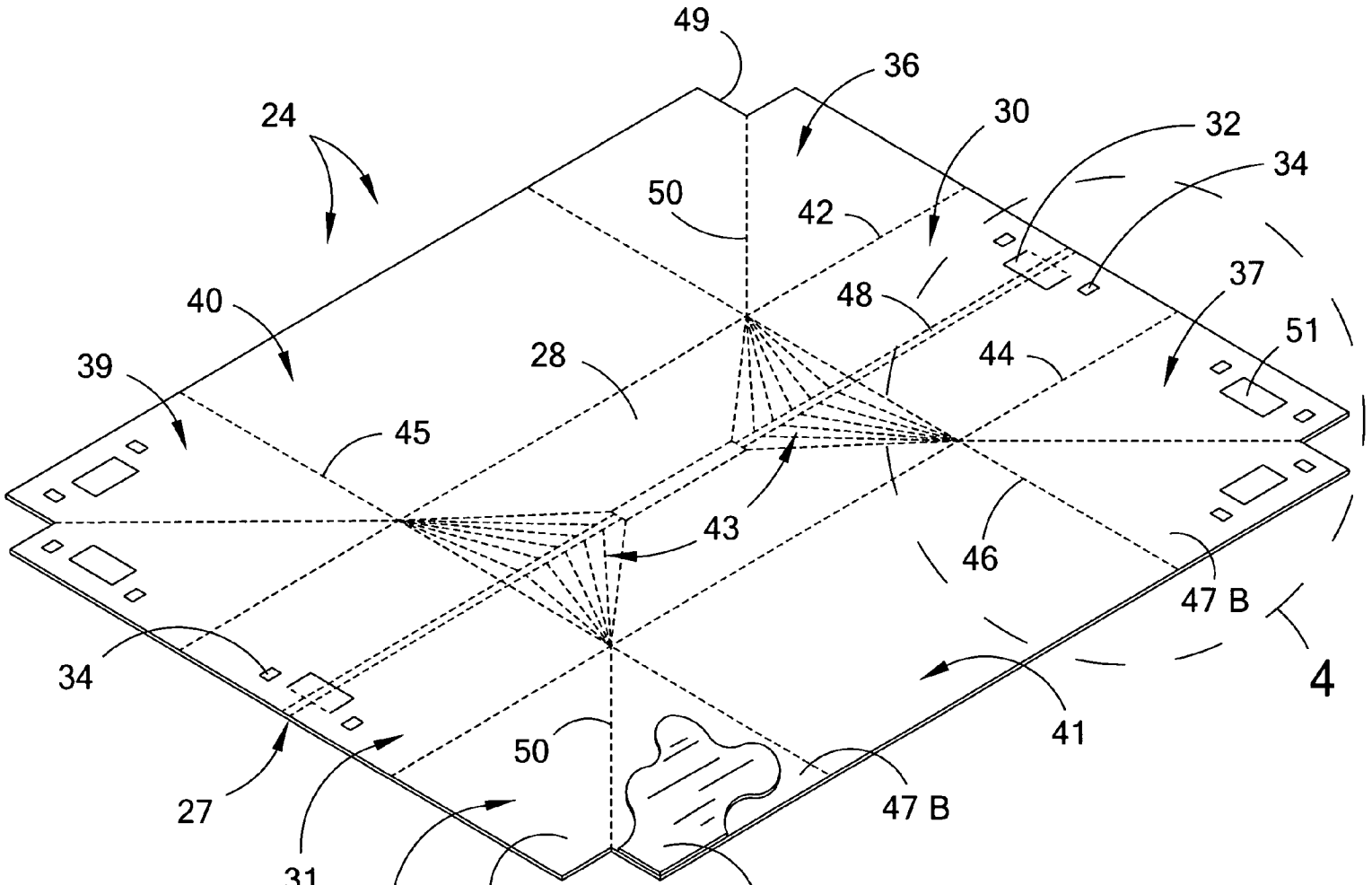
FIG. 3 is a fragmentary, isometric view of a corrugated, pre-scored blank for all embodiments of our invention that is foldably deployed to form the preferred carton.

Preferably blank 24 (FIG. 3) is formed from a die-cut piece of corrugated sheet material. It can also be formed from paperboard, cardboard, or other fibrous sheet materials known in the art, and it is preferably coated with a polyethylene plastic layer 26 (FIG. 3). Blank 24 is preferably somewhat rectangular, having a length (i.e., that runs from left to right in FIG. 3) somewhat greater than its width. Blank 24 has been appropriately scored by a plurality of score lines that the blank into a plurality of separate but integral panels. For purposes of clarity, it should be appreciated that the upper or top plastic surface 26 projecting towards the viewer in FIG. 3 becomes the interior surface of the carton 21 after folding. Of course the various panels and portions of panels exposed in FIG. 3 have a corresponding undersurface not seen until folding occurs.

The preferred blank 24 comprises a generally rectangular center panel 28. Panel 28 is integral with a pair of end panels 30, 31, four, integral, corner panels 36, 37, 38 and 39, and integral side panels 40, 41. The diametrically spaced-apart corner panels 36-39 interconnect the center panel 28 with the end panels 30 and 31 and with the side panels 40, 41. Elongated, parallel fold lines 42 and 44 (FIG. 3) extend the length of the blank 24, and separate side panels 40, 41 from center panel 28. Elongated, parallel fold lines 45, 46 separate end panels 30, 31 from center panel 28. Fold lines 45 and 46 are perpendicular to fold lines 42 and 44. Interior elongated, double-scored fold line 48 divides the blank 24 in half and is parallel to fold lines 42, 44.

The preferred central panel 28 is provided at each of its ends with a plurality of knock-down score line arrays, generally designated by the reference numeral 43. These generally V-shaped arrays 43 each comprise multiple, independent and angled score lines that enable the carton 21 to be "knocked down" or non-destructively and temporarily "squashed" for transport or temporary storage. This structure and phenomena are described in the Wes-Pak patents discussed above.

Preferably, each corner panel 36-39 is similarly sized and configured. Each is somewhat square, with an outer notch 49 cut into it's diametrically, outwardly extending vertice. All corner panels 36-39 include a diagonal score line 50 defined through their center, running from a vertice of central panel 28 to the notch 49. Score lines 50 divide each corner panel into a pair of integral, foldably connected halves 47A and 47B.

Figure 4:
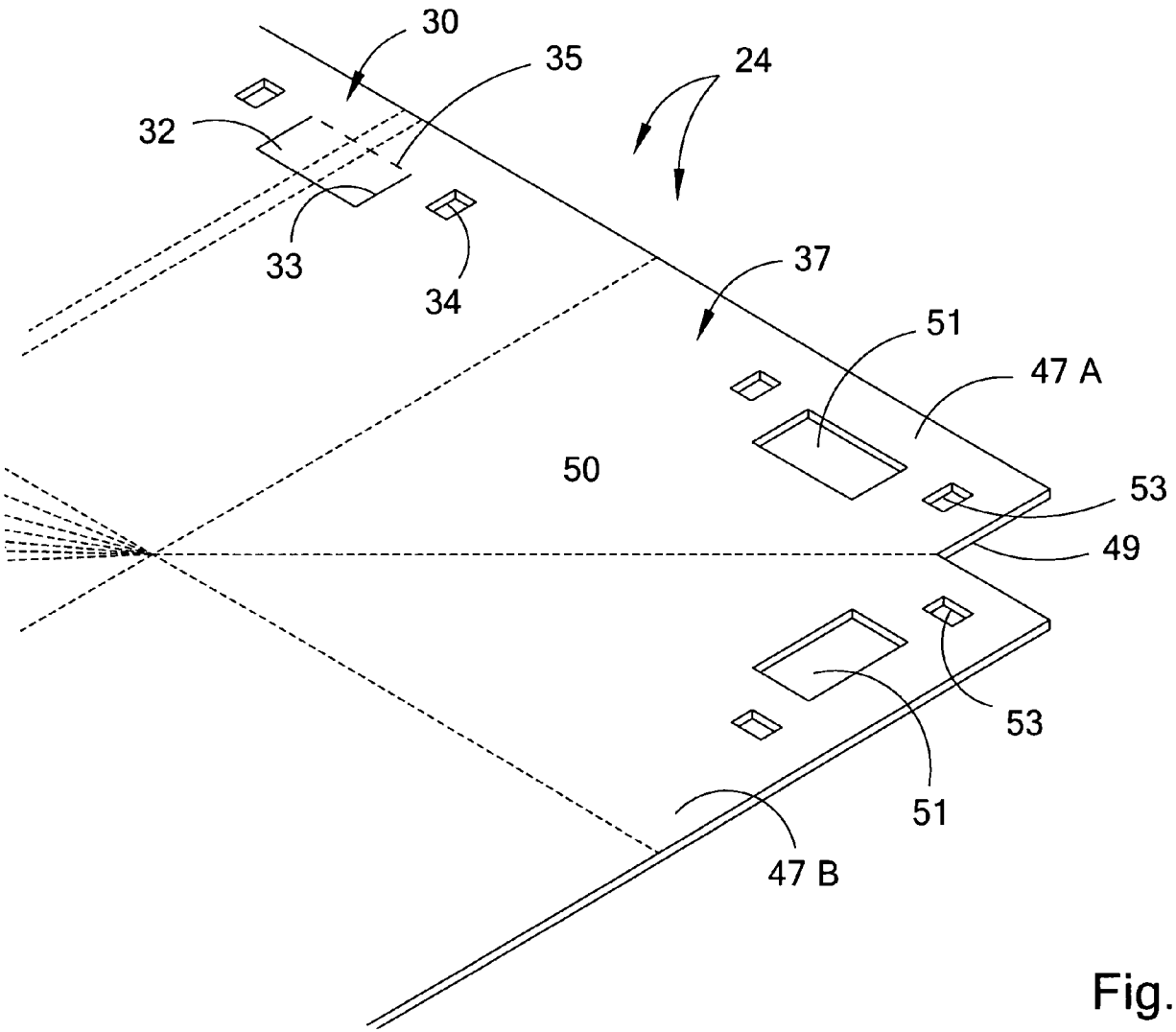
FIG. 4 is an enlarged, fragmentary isometric view of circled region 4 of FIG. 3.

The flap system 27 comprises foldable flaps in the end panels that cooperate with aligned orifices defined in a pair of corner panels. As best seen in FIGS. 3 and 4, each end panel 30 and 31 has a generally rectangular flap 32 formed adjacent its outermost end. Flaps 32 are defined by and disposed within a rectangular, cutout orifice 33, being semi-permanently and foldably secured within orifice 33 at fold line 35 (FIG. 4). Smaller, spaced-apart anchor holes 34 are defined at opposite ends of the flaps 32. These square, spaced-apart anchor holes 34 can receive ends of a preferred plastic handle as explained later. Flaps 32 deflect inwardly when the carton is assembled, providing a smooth surface that contacts the hands of a user lifting or manipulating the carton.

The flap system 27 is preferably reinforced with multiple plies. To this effect, two diametrically oppositely disposed corner panels 37, 39 are provided with a pair of rectangular cutouts and companion anchor holes that, when the blank 24 is folded to form the carton 21, register with each other and the cutout orifice 33 and anchor holes 34 defined in the end panels. As seen in FIG. 3, the other pair of diametrically opposite corner panels 36 and 38 does not have the cutouts. As best seen in FIG. 4, each half 47A, 47B of the corner panel 37 has a rectangular cutout 51 adjacent notch 49. Two spaced apart anchor holes 53 are disposed on opposite ends of the cutouts 51. When halves 47A and 47B are folded together, the cutouts 51 register with one another, and the anchor holes 53 register with one another as well. Also, cutouts 51 register with the end panel cutout orifices 33 discussed earlier, and the corner panel anchor holes 53 register with end panel anchor holes 34. To accommodate this configuration, however, the panels must be folded in a new and different fashion, as explained further below.

Figure 5:
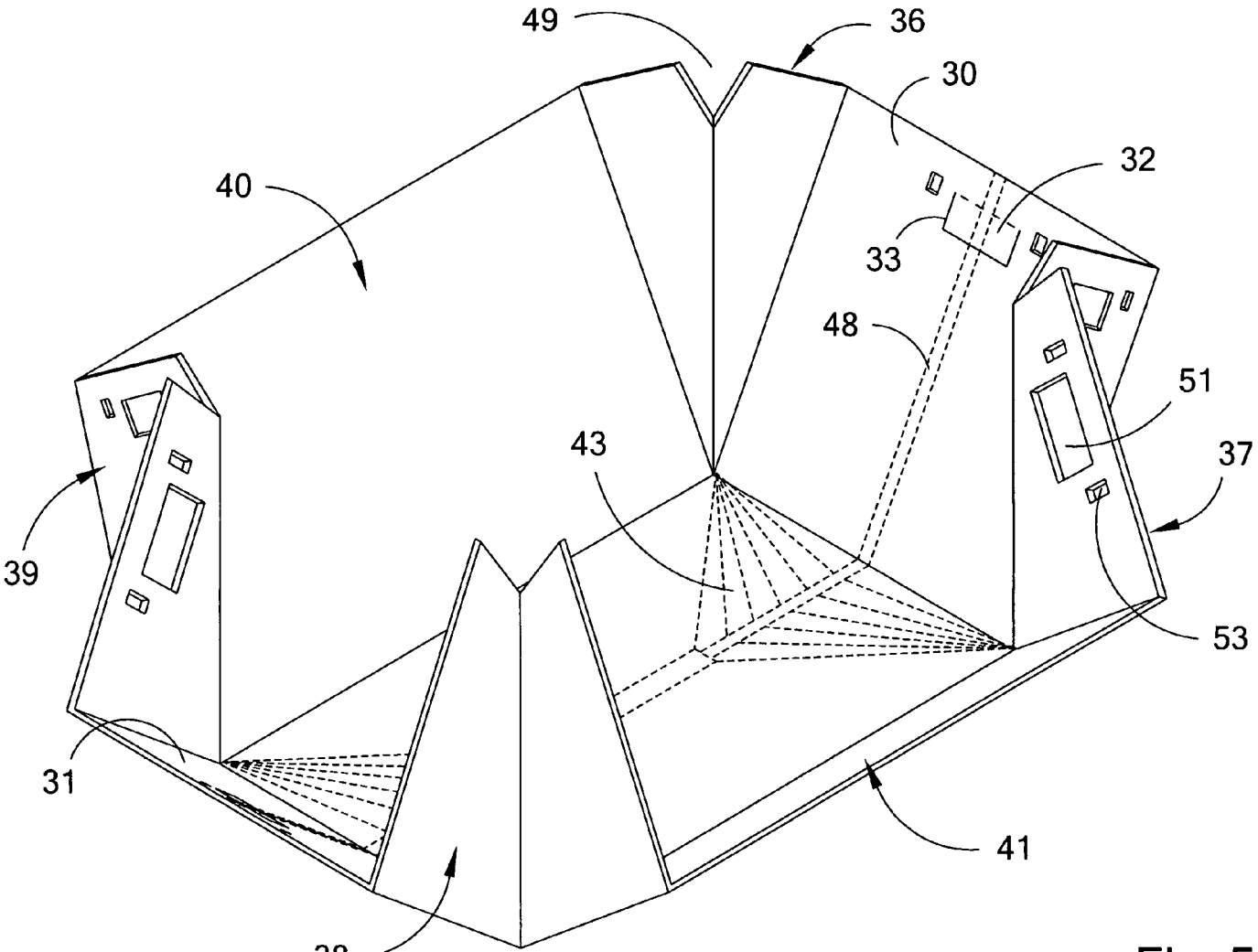
FIG. 5 is an isometric view of the blank of FIG. 3, showing it partially folded and deployed.

As seen in FIG. 5, deployment of the carton 21 may commence by manipulating and folding one or more panels, such as corner panels 36-39, which deflect angularly inwardly as in FIG. 4. Those with skill in the art will immediately recognize that various assembly steps may be juxtapositioned during box erection. Erection may commence as in FIG. 4 by folding the corner panels 36-39 about their diagonal score lines 50, and pushing them inwardly, with the corner panels folded into abutting triangular halves. The side panels 40, 41 and end panels 30, 31 are folded upwardly. The deployed carton 21 (FIG. 5) results. Importantly, the folded corner panel 37 will abut the interior of the folded end panel 30, and the folded corner panel 39 will abut the interior of the end panel 31. Corner panels 36 and 38, on the other hand, will interiorly abut the deployed side panels 40 and 41. Interiorly panels are glued in place substantially as known in the art.

Figure 6:
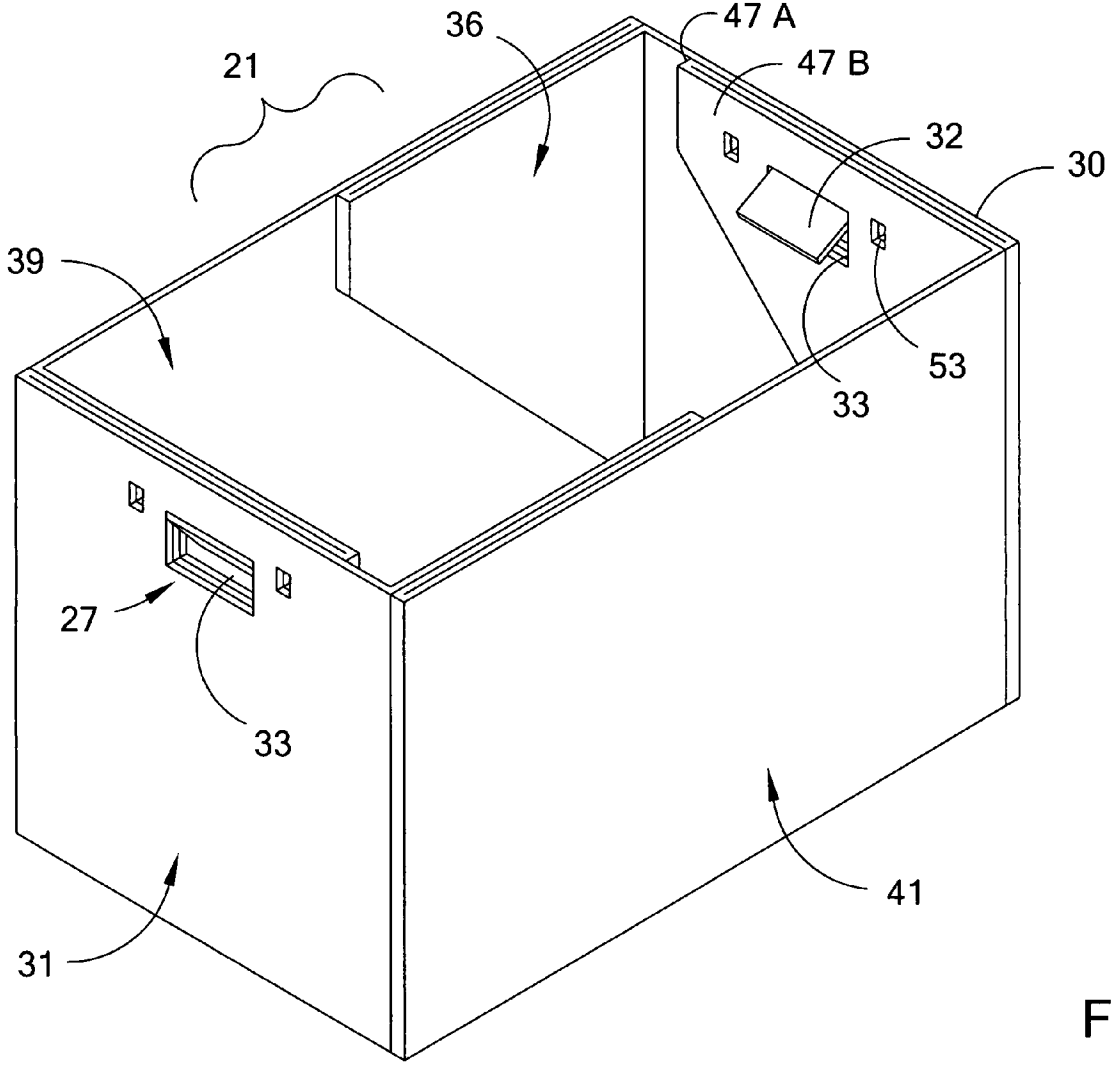
FIG. 6 is an isometric view showing the preferred carton which results after folding the blank of FIG. 3.

As a result, the deployed carton has a triple-ply construction at the end panels, as seen in FIG. 6. It is to be noted that corner panel halves 47A and 47B neatly overlie the interior of the deployed end panel, either the orifices 51 (i.e., FIG. 4) registering with end panel cutout orifice 33. Orifices 51 will also register with end panel cutout orifice 33. Thus when the end panel flaps 32 are pushed inwardly, they will contact three plies of material comprising the flap system 27. The flaps 32 provide a convenient and comfortable contact point for ones hands when grasping the carton 21, and the three ply construction as aforesaid distributes force evenly and strengthens the arrangement.

Figure 7:
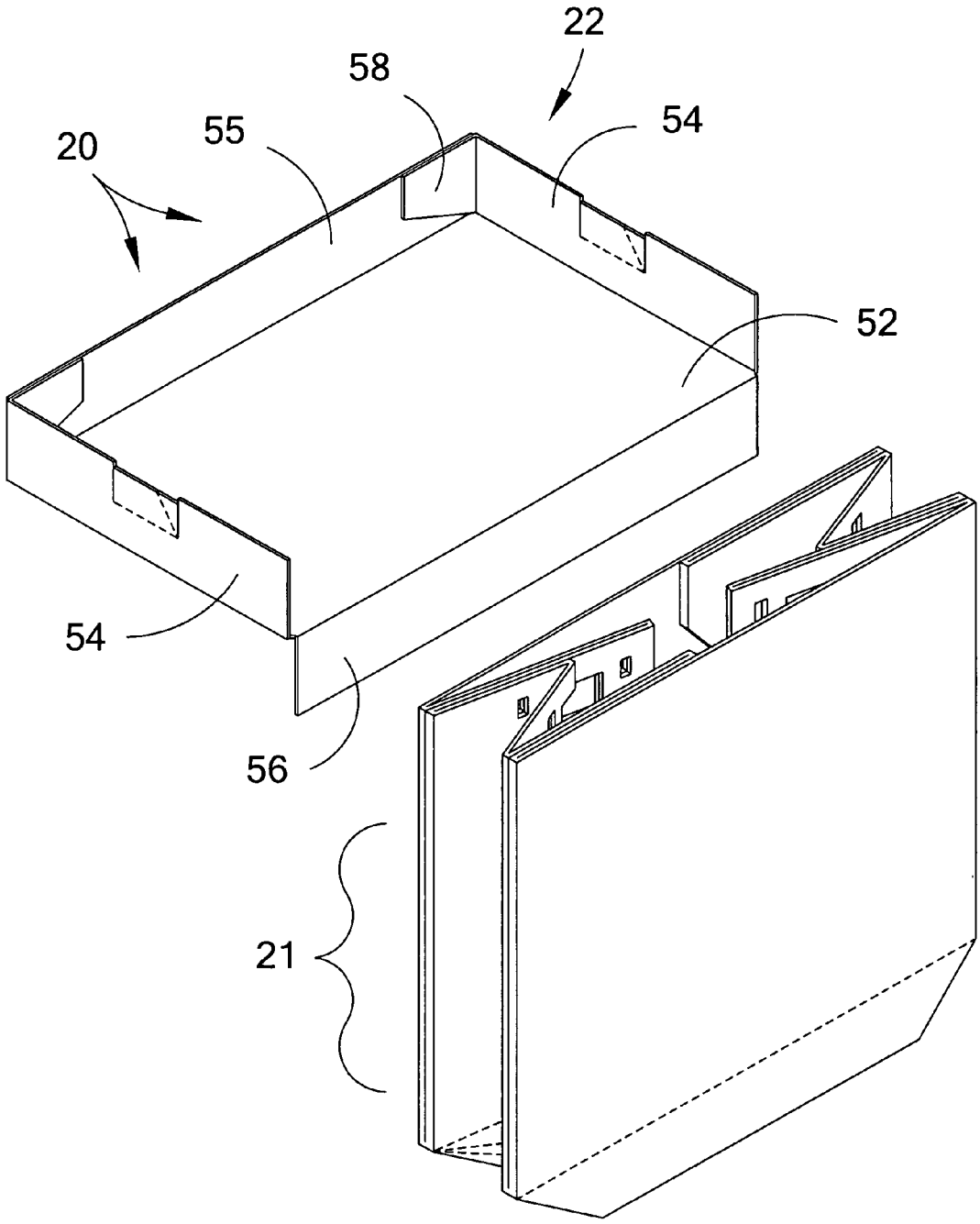
FIG. 7 is a partially-exploded isometric view similar to FIG. 6 but showing the carton in a fully collapsed orientation, with the uncollapsed lid about to be fitted to the carton.
Figure 8:
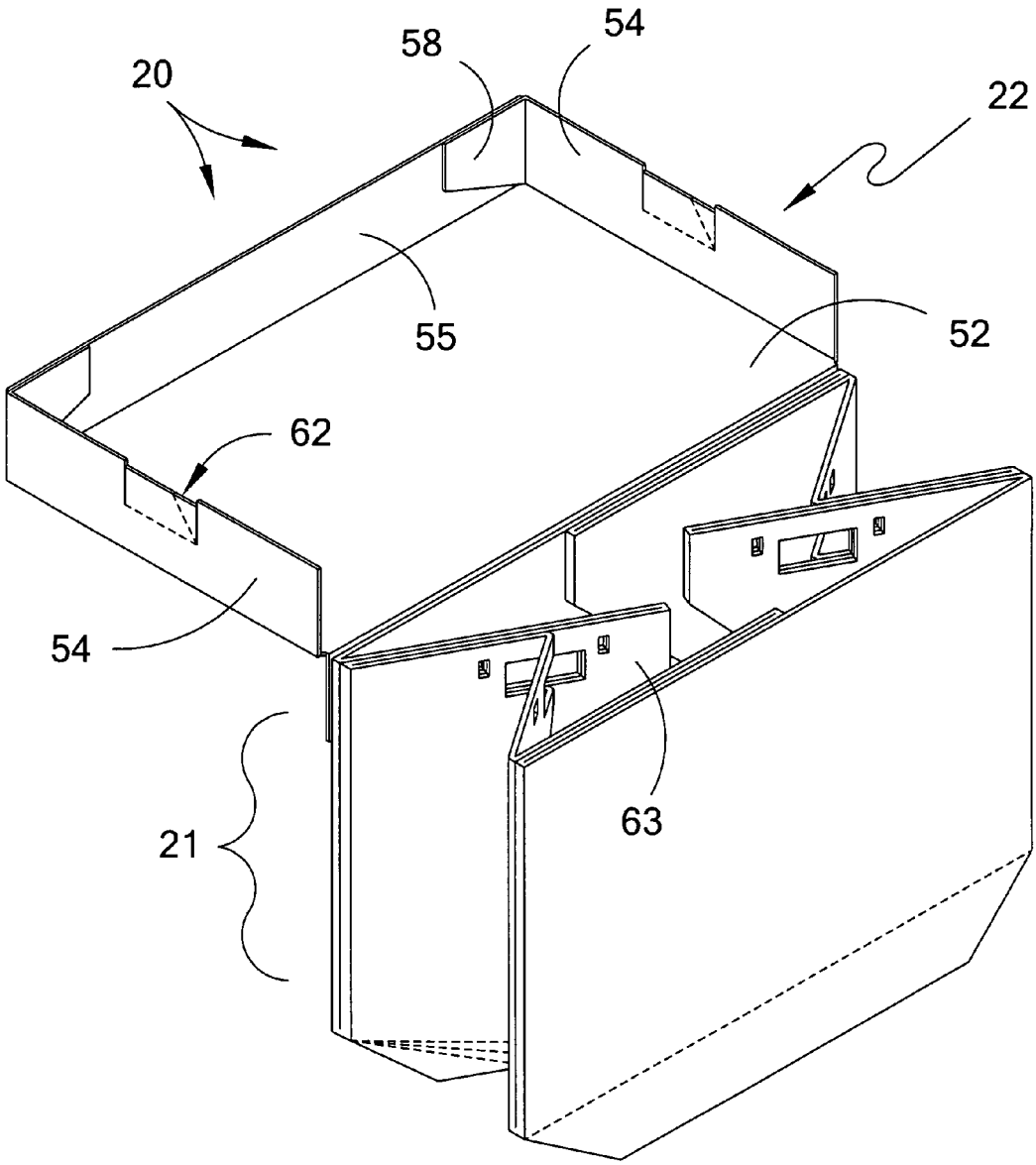
FIG. 8 is an isometric view of the container showing the carton disposed in a partially collapsed orientation with the lid affixed, and showing the unglued portions of the folded corner panels.
Figure 9:
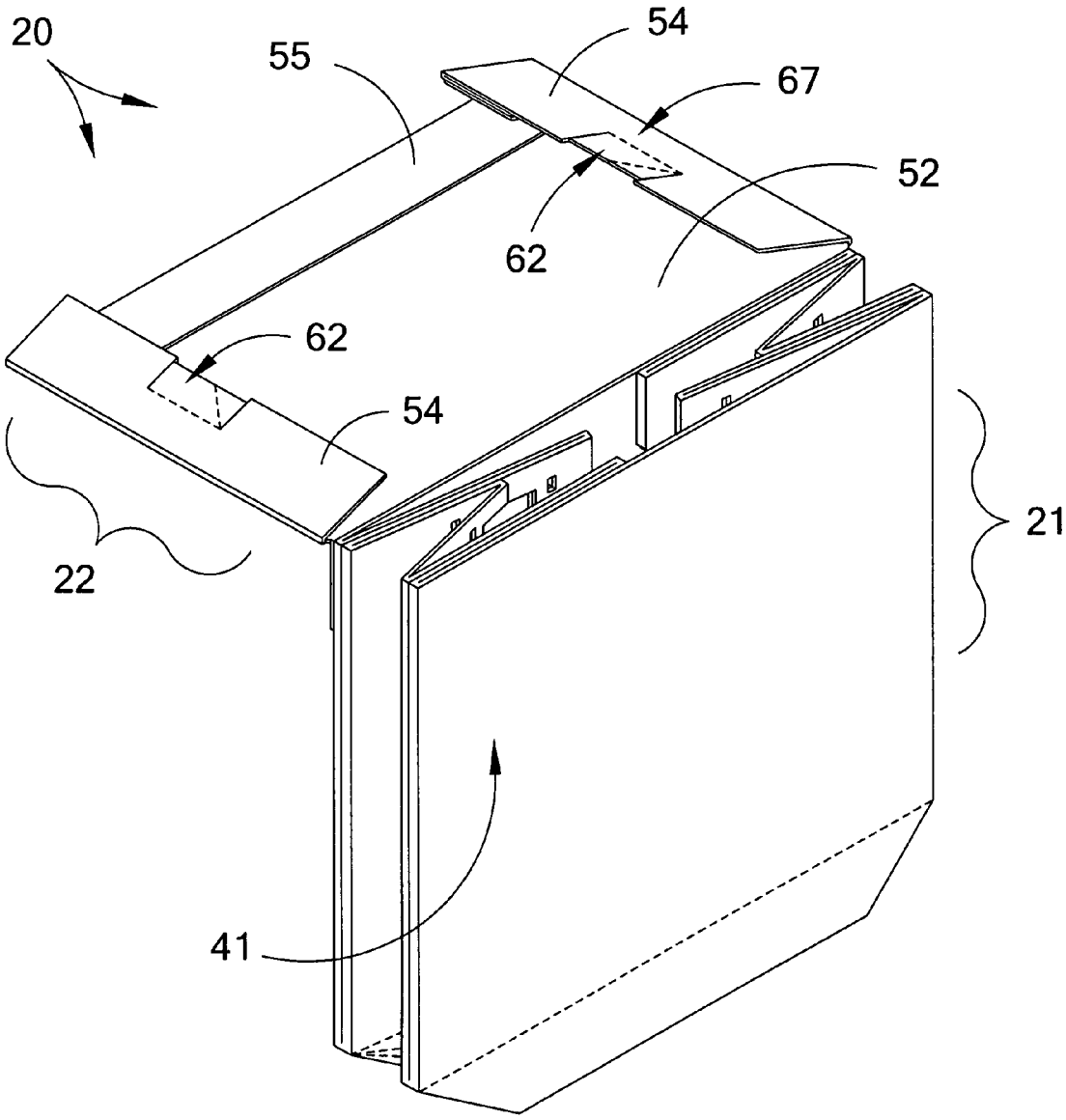
FIG. 9 is an isometric view showing how the container collapses for storage and shipment.
Figure 10:
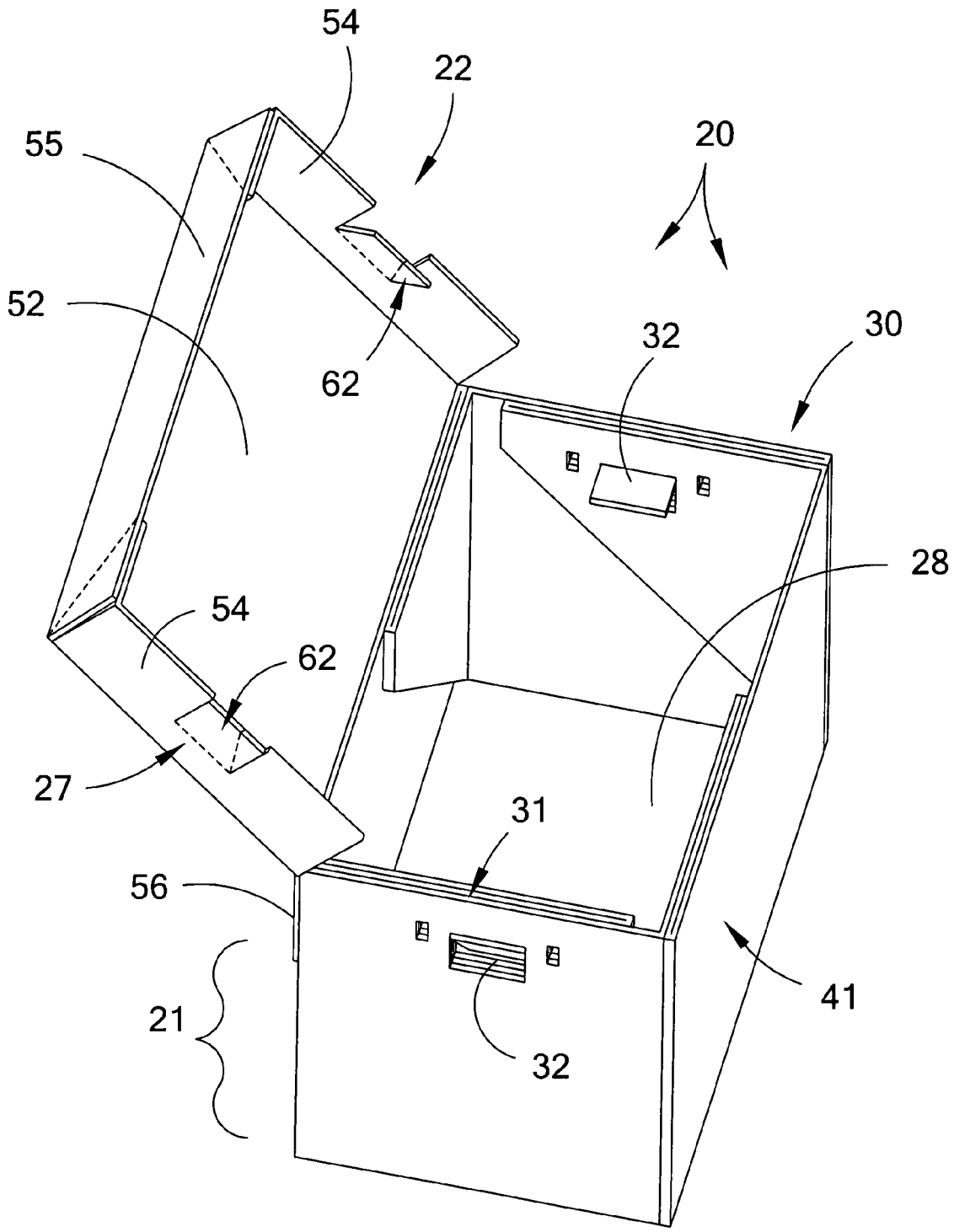
FIG. 10 is an isometric view of the assembled and deployed container showing it ready for use.

Preferably, carton 21 can be "knocked down" or collapsed by pushing its bottom down, deflection of which is enabled by knock-down score lines 43, such that the carton 21 transforms between the deployed configuration of FIG. 5, through the intermediate position of FIG. 6, to the flat, collapsed, orientation of FIGS. 7-9. Importantly, with the corner panels folded into contact with end panels, the corner panels cannot be fully glued. Stated another way, and referencing FIG. 8, the interior triangular portion 63 of the folded corner panels is not glued. If it were glued, then the knock-down feature of the box discernible from a comparison of FIGS. 8 and 9 would not work.

Primarily referencing FIGS. 6, 7, 9 and 10, the lid 22 is attached to the carton 21 to form the container 20. Lid 22 comprises a central panel 52 that is foldably divided from integral, spaced apart, end panels 54 and side panels 55, 56 (i.e., FIG. 9). The lid end panels 54 comprise foldable flaps 58 that are affixed to the edges of side panel 55 when the lid is constructed. The opposite side panel 56 is folded the opposite vertical direction assumed by opposite lid side panel 55, extending vertically downwardly instead of upwardly (i.e., as viewed in FIG. 7). Panel 56 is glued to the side panel 40 of the carton 21 to complete assembly of the container 20. The lid panels are foldable or compressible into a flat orientation as seen in FIG. 9.

Importantly, the lid's end panels are provided with flaps 62 extending between edges 60 (FIG. 11) of the cutout region. Fold lines 67 (FIG. 11) are scored into the lid panels 54, defining the flaps 62. When the lid is attached to the carton 21, lid flaps 62 are aligned with the previously discussed flaps 32 defined in the carton end panels. In other words, the deflectable lid end flaps 62 register with carton cutouts 33 when the lid 22 is affixed, as in FIGS. 1 and 2.

Figure 11:
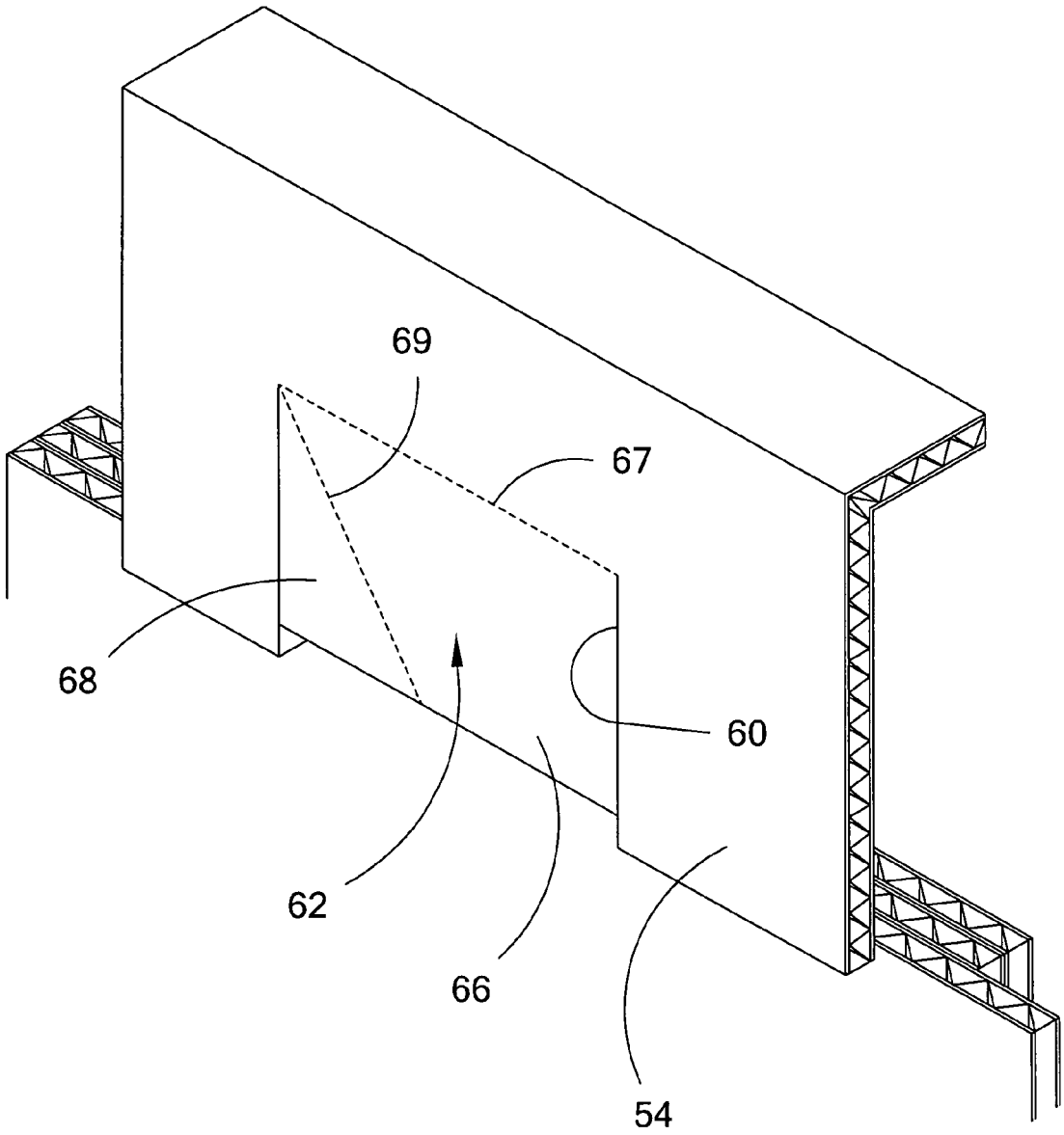
FIG. 11 is an enlarged, fragmentary and partially exploded isometric view of circled region 11 illustrated in FIG. 1.
Figure 12:
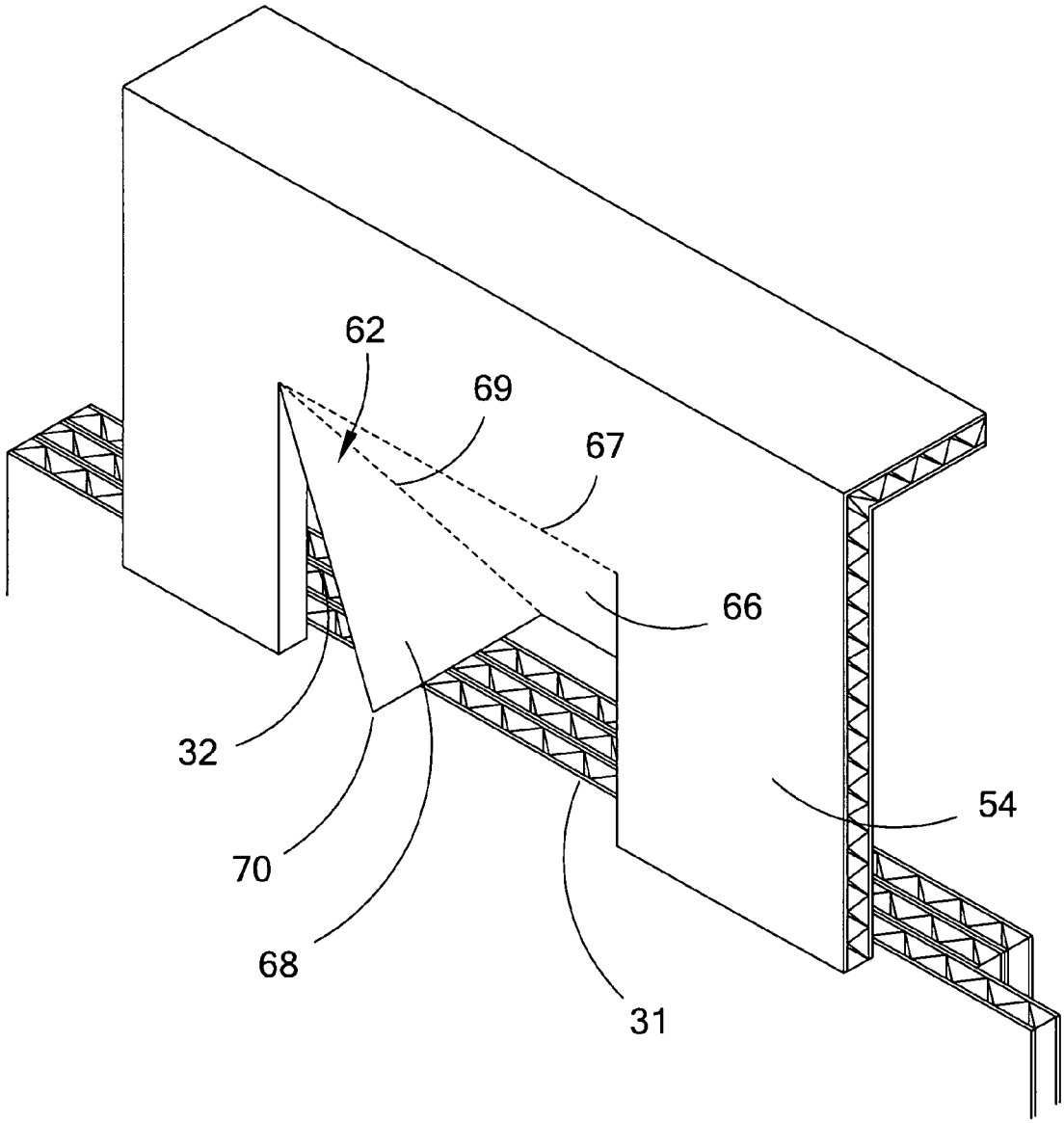
FIG. 12 is an enlarged, fragmentary and partially exploded isometric view of circled region 12 illustrated in FIG. 2.
Figure 13:
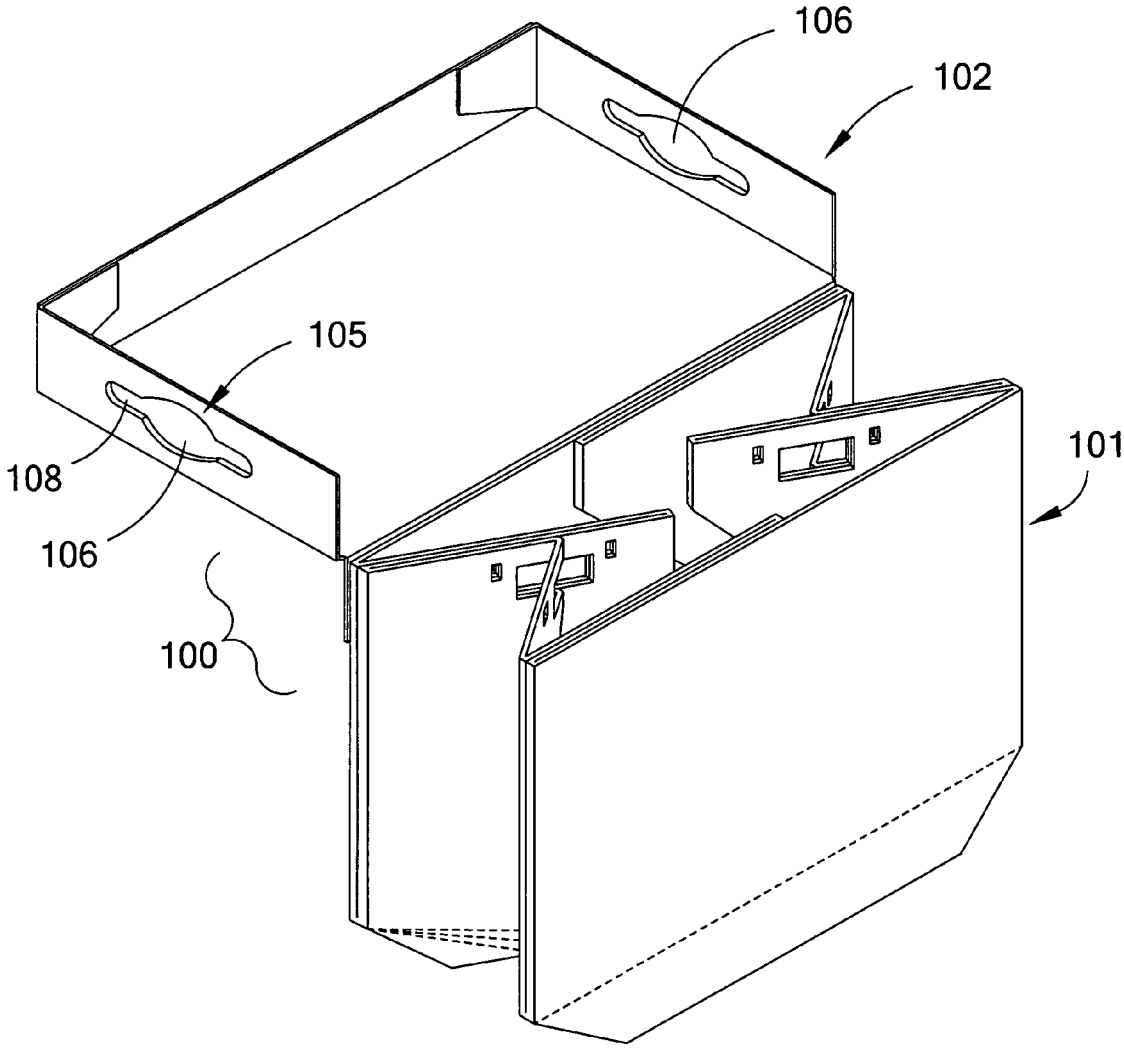
FIG. 13 is an isometric view of a the preferred container, with the preferred carton shown partially collapsed, and with a the preferred lid attached.
Figure 14:
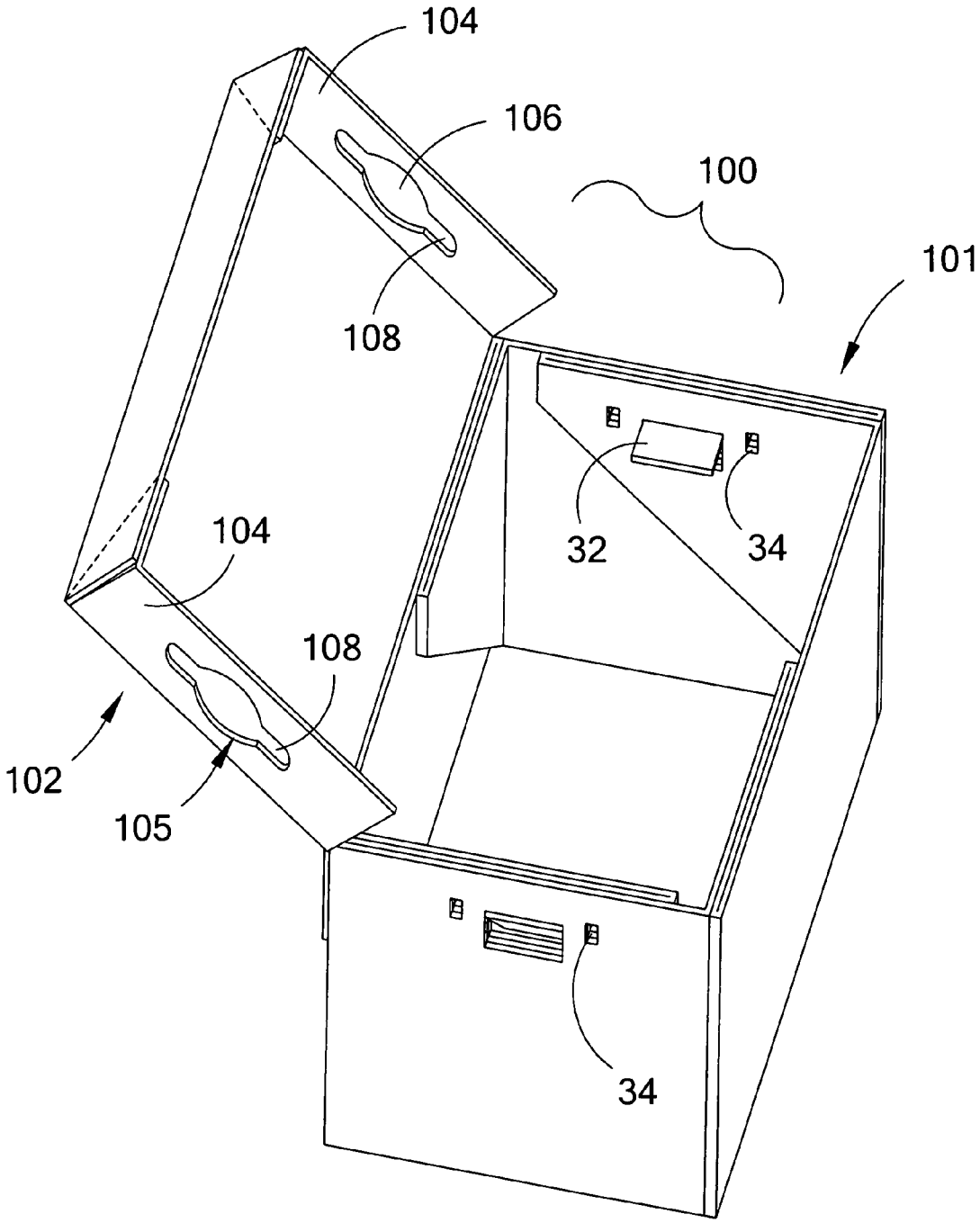
FIG. 14 is an isometric view of the preferred container with the preferred lid open.
Figure 15:
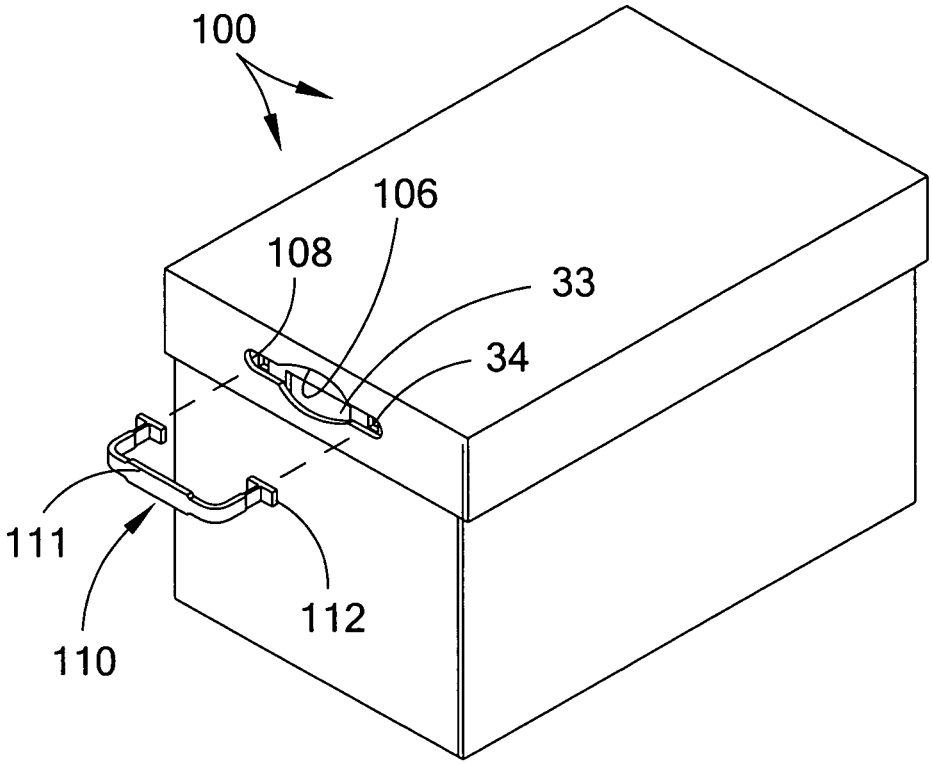
FIG. 15 is a partially exploded isometric view of the preferred container, with the preferred lid disposed atop the preferred carton, and with separate plastic handles about to be fitted to the anchor holes; and, FIG. 16 is an isometric view of the preferred container with the separate handles installed.

Referencing FIGS. 11 and 12, the rectangular flap 62 a locking segment which has been designated by the reference numeral 68 (FIG. 12). Flap 62 preferably comprises a major segment 66 and a minor triangular segment 68 that are separated by a diagonal score line 69 for folding. Scored fold line 67 enables flap segment 66 to be pressed inwardly into the cutout orifice 33, and folded upwardly. Minor flap segment 68 folds about scored fold line 69, and projects outwardly, as in FIG. 12. As the flap 62 is turned inwardly, the minor flap segment 68 forms a temporary latch, with its apex 70 (FIG. 12) pointing outwardly, contacting the interior end panel region of the carton, and biasing the flap 62 inwardly. At this time lid flap segment 66 bears against carton flaps 32 discussed earlier. When the lid is affixed to the carton 21, gentle hand pressure applied against the lid flap 62 thus temporarily maintains the lid in place as the minor flap segment 68 forms a binding effect. When attempting to remove the lid, the flaps can be overcome by sufficient upwardly directed pressure upon the lid, so that they will yield when desired to remove the lid.

Figure 16:
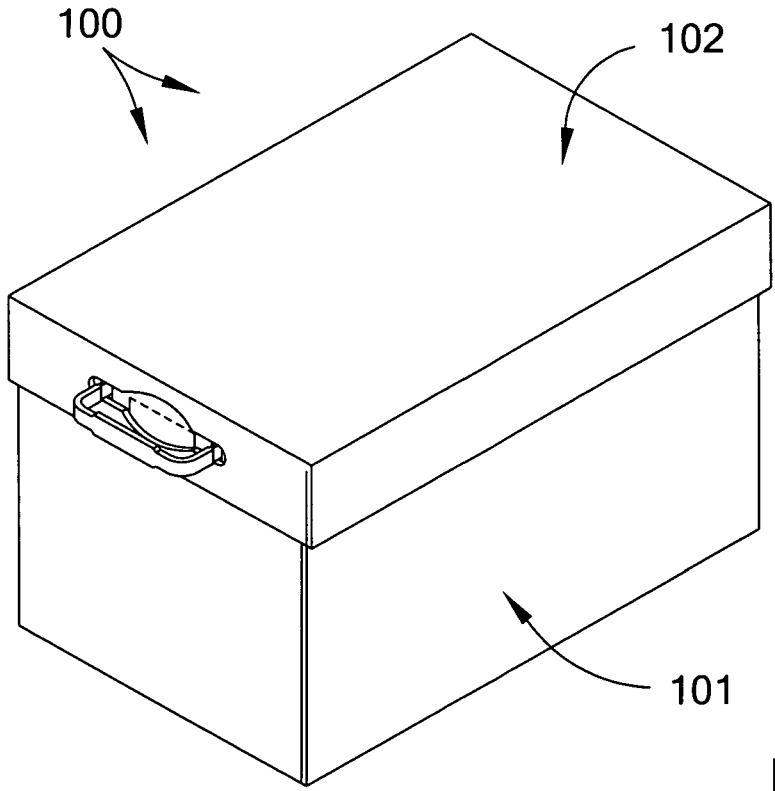

Turning now to FIGS. 13-16, the preferred container 100 comprises the preferred carton 101 that is identical with carton 21 discussed earlier, and a preferred lid 102. Lid 102 is substantially similar to lid 22, but its end panels 104 lack flaps 62. Instead, the lid end panels comprise actuating orifices 105 that register, upon assembly, with the cutout regions 32 of cartons 101. The orifices 105 comprise a central, elliptical hole 106 that includes a pair of narrower, oppositely directed end slots 108, that overlie handle anchor holes 34 formed in the end panels of the carton 101. The elliptical hole 106 provides accessibility to press the carton flaps 32. The slots 108 permit a resilient handle 110 (FIG. 15) to be attached, by first bending handle body 111 and then press fitting the anchoring feet 112 through the slots 108 into the anchor holes 34 discussed previously. This results in handle placement as seen in FIG. 16.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. A container comprising:

a carton made from a blank comprising a center panel, a pair of foldable end panels, a pair of foldable side panels, four foldable corner panels having a score line dividing them into halves, the end panels having cutout regions with foldable flaps within the cutout regions and spaced anchor holes defined adjacent the cutout regions;

wherein at least a pair of diametrically opposed corner panels has cutout holes and anchor holes defined in each of their halves, the corner panel cutout holes and anchor holes adapted to register with the end panel cutout regions and anchor holes when said diametrically opposed corner panels are folded against the end panels when the carton is assembled;

a lid adapted to placed upon the carton, the lid comprising a central lid panel foldably divided from integral end panels and integral side panels, one of the side panels extending vertically downwardly and coupled to the carton, the lid end panels comprising actuating orifices that register, upon assembly, with the cutout regions and cutout holes; and, a resilient handle comprising a body with a pair of anchor feet on opposite ends adapted to be pressed through the aligned anchor holes for attachment to the container.

2. The container as defined in claim 1 wherein the carton and the lid may be collapsed.

3. The container as defined in claim 1 wherein the lid actuating orifices comprise a generally elliptical central hole and oppositely directed end slots, wherein the elliptical hole overlies the end panel foldable flaps, and the end slots overlie the end panel anchor holes.

4. The container as defined in claim 3 wherein the lid panels are foldable into a flat orientation.

5. A container comprising:

a carton made from a blank comprising a center panel, a pair of foldable end panels, a pair of foldable side panels, four foldable corner panels having a score line dividing them into halves, the end panels having cutout regions with foldable flaps within the cutout regions and spaced anchor holes defined adjacent the cutout regions;

wherein at least a pair of diametrically opposed corner panels has cutout holes and anchor holes defined in each of their halves, the corner panel cutout holes and anchor holes adapted to register with the end panel cutout regions and anchor holes when said diametrically opposed corner panels are folded against the end panels;

a lid adapted to placed upon the carton, the lid comprising a central lid panel foldably divided from integral end panels and integral side panels, one of the side panels extending vertically downwardly and coupled to the carton;

the lid end panels having rectangular regions defining generally rectangular lid flaps that are adapted to register with said cutout regions in the carton; and a resilient handle comprising a body with a pair of anchor feet on opposite ends adapted to be pressed through the aligned anchor holes for attachment to the container.

6. The container as defined in claim 5 wherein said lid flaps comprise a major segment and a minor segment separated by a diagonal score line, and wherein when the lid flap is pressed into the end panel cutout region when the lid is attached to the carton, the minor segment deflects toward and yieldably contacts an end panel within the carton to bias the lid flap inwardly.

7. The container as defined in claim 6 wherein the carton may be collapsed and the lid panels are foldable into a flat orientation.

8. The container as defined in claim 7 wherein the minor segment comprises an apex that engages the end panel.

9. A carton comprising:

a center panel, a pair of foldable end panels, a pair of foldable side panels, four foldable corner panels having a score line dividing them into halves, the end panels having cutout regions with foldable flaps within the cutout regions and spaced apart anchor holes defined adjacent the cutout regions;

wherein at least a pair of diametrically opposed corner panels have cutout holes and anchor holes defined in each of their halves that are adapted to register when the halves are folded together, the corner panel cutout holes and anchor holes adapted to register with the end panel cutout regions and anchor holes when said diametrically opposed corner panels are foldably deployed against the end panels; and, a resilient handle comprising a body with a pair of anchor feet on opposite ends adapted to be pressed through the aligned anchor holes for attachment to the carton.

10. A container for packaging, distributing, handling and storing sterile and non-sterile medical surgical supplies, said container comprising:

a carton folded from a blank comprising a center panel, a pair of foldable end panels, a pair of foldable side panels, four foldable corner panels having a score line dividing them into halves that are adapted to be folded together, the end panels having cutout regions with foldable flaps within the cutout regions and spaced anchor holes defined adjacent the cutout regions;

wherein at least two diametrically opposed corner panels comprise cutout holes and anchor holes defined in each of their halves, the cutout holes and anchor holes defined in one half adapted to register with the cutout holes and anchor holes defined in the other half when the corner panel halves are folded together, and the corner panel cutout holes and anchor holes adapted to register with the end panel cutout regions and anchor holes when said diametrically opposed corner panels are folded against the end panels when the carton is assembled;

a lid adapted to placed upon the carton, the lid comprising a central lid panel foldably divided from integral end panels and integral side panels, one of the side panels extending vertically downwardly and coupled to the carton, the lid end panels comprising actuating orifices that register, upon assembly, with the cutout regions and cutout holes defined in the carton end panels and carton corner panels; and, a resilient handle comprising a body with a pair of anchor feet on opposite ends adapted to be pressed through the aligned anchor holes for attachment to the container.

11. The container as defined in claim 10 wherein the carton and the lid may be collapsed, and wherein the lid panels are foldable into a flat orientation.

12. The container as defined in claim 10 wherein the lid actuating orifices comprise a generally elliptical central hole and oppositely directed end slots, wherein the elliptical hole overlies the end panel foldable flaps, and the end slots overlie the end panel anchor holes.

13. A container for packaging, distributing, handling and storing sterile and non-sterile medical surgical supplies, said container comprising:

a collapsible carton made from a blank comprising a center panel, a pair of foldable end panels, a pair of foldable side panels, four foldable corner panels having a score line dividing them into halves, the end panels having cutout regions with foldable flaps within the cutout regions and spaced anchor holes defined adjacent the cutout regions;

wherein a pair of diametrically opposed corner panels has cutout holes and anchor holes defined in each of their halves, the corner panel cutout holes and anchor holes adapted to register with the end panel cutout regions and anchor holes when said diametrically opposed corner panels are folded against the end panels;

a collapsible lid adapted to placed upon the carton, the lid comprising a central lid panel foldably divided from integral end panels and integral side panels;

the lid end panels having rectangular regions defining generally rectangular lid flaps that are adapted to register with said cutout regions in the end panels of said carton;

a resilient handle comprising a body with a pair of anchor feet on opposite ends adapted to be pressed through the aligned anchor holes for attachment to the container;

said lid flaps comprising a pair of segments separated by a score line; and, wherein, when the lid flap is pressed into the end panel cutout region when the lid is attached to the carton, one of said segments deflects towards and yieldably contacts an end panel within the carton to bias the lid flap inwardly.

14. A carton for packaging, distributing, handling and storing sterile and non-sterile medical surgical supplies, said carton comprising:

a center panel, a pair of foldable end panels, a pair of foldable side panels, four foldable corner panels having a score line dividing them into halves, the end panels having cutout regions with foldable flaps within the cutout regions and spaced apart anchor holes defined adjacent the cutout regions;

wherein two diametrically opposed corner panels have cutout holes and anchor holes defined in each of their halves that are adapted to register when the halves are folded together, the corner panel cutout holes and anchor holes adapted to register with the end panel cutout regions and anchor holes when said diametrically opposed corner panels are foldably deployed against the end panels; and, a resilient handle comprising a body with a pair of anchor feet on opposite ends adapted to be pressed through the aligned anchor holes for attachment to the carton.

* * * * *